US005544980A

United States Patent [19]

Seegmiller

[11] Patent Number: 5,544,980

[45] Date of Patent: Aug. 13, 1996

[54] ANCHOR STRUCTURE

[76] Inventor: Ben L. Seegmiller, 143 S. 400 East, Salt Lake City, Utah 84111

[21] Appl. No.: 225,627

[22] Filed: Apr. 11, 1994

[51] Int. Cl.[6] ..... E21D 20/02

[52] U.S. Cl. ..... 405/259.6; 405/259.1; 411/15

[58] Field of Search ..... 405/259.5, 259.6, 405/259.1; 411/1, 8, 15–20

[56] References Cited

U.S. PATENT DOCUMENTS

| | | | |
|---|---|---|---|
| 3,298,144 | 1/1967 | Fischer | 405/259.6 X |
| 3,699,687 | 10/1972 | Bourland | 405/259.6 |
| 4,055,051 | 10/1977 | Finney | 405/259.6 |
| 4,263,832 | 4/1981 | Lang et al. | 405/259.6 X |
| 4,555,206 | 11/1985 | Sweeney | 405/259.6 X |
| 4,601,614 | 7/1986 | Lane et al. | 405/259.6 |
| 4,648,753 | 3/1987 | Stephan | 405/259.6 X |
| 4,659,258 | 4/1987 | Scott | 405/259.6 |
| 4,976,571 | 12/1990 | Mraz et al. | 405/259.6 |
| 5,013,192 | 5/1991 | Scott | 405/259.6 X |
| 5,104,266 | 4/1992 | Daryoush et al. | 405/259.5 |
| 5,352,066 | 10/1994 | Schaeffer et al. | 405/259.6 |

*Primary Examiner*—Dennis L. Taylor
*Attorney, Agent, or Firm*—M. Ralph Shaffer

[57] ABSTRACT

Anchor structure suitable for retentive placement in a borehole, whereby to anchor an elongated anchor bolt in a fixed position within such borehole; the anchor structure is designed for mechanical and also setting-medium system securement within the borehole, the mechanical structure utilized being radially expansive and, by such means, offering an immediate anchor by which the setting-medium used is given time to set up.

3 Claims, 4 Drawing Sheets

ANCHOR STRUCTURE

The present invention relates to anchor structures, particularly those of the type commonly referred to as point anchors and, more particularly, to new and improved anchor structure wherein a desired setting-medium system facilitating the essentially permanent anchoring of an anchor bolt, for example, is supplemented by structure which may be expanded outwardly to grip into the interior wall of the borehole utilizing the anchor, whereby an immediate retention is achieved while allowing the setting-medium system sufficient time lapse to set up and thus supply a permanent anchoring facility.

DESCRIPTION OF PRIOR ART

In the past a number of different types of anchors have been used for anchoring elongated rods, shafts, anchor bolts, roof bolts, and so forth, in given boreholes in mine strata, in cement reinforcement structures, civil engineering projects, and so forth.

Commonly, elongated holes in mine strata or other formations are provided and into which a respective anchor is to be placed, the latter being used for securing in position elongated members such as anchor bolts, by way of example. Customarily, the agent for retention takes the form either as a setting-medium system anchor or a mechanical, radially expansive anchor. Where the resin- or other setting-medium anchor alone is employed, surface undulations on the anchor bolt shaft, commonly, a structural rebar segment, are relied upon, during periods of revolvement thereof, to penetrate and mix the resin system or other setting-medium; the so-activated system is given a sufficient period of time to set up and hold the anchor bolt in place. During this time interval it is necessitated that a work machine be used, or the workman simply use his hand, to hold the anchor bolt in the hole while the setting-medium is given time to set up and harden.

Another type of anchor, commonly referred to as a mechanical point anchor, is radially expansive structure, sometimes including the equivalent of a mechanical collet, wherein a series of elements are held together by the collet but are urgeable outwardly in radial fashion outwardly upon the introduction of the threaded end of an anchor bolt. Thus, the threaded bolt end is introduced into the point anchor and its threading is simultaneously accompanied by a mutual radial expansion of the anchor elements whereby the outer surfaces of such elements can grip into the side wall of the hole in which the point anchor is to be placed.

No patent literature is known which bears directly upon the invention as described and claimed here. U.S. Pat. No. 4,096,944, however, is of peripheral interest, and its disclosure is fully incorporated herein by way of reference as disclosing an alternate setting-medium system.

It would be desirable, of course, for suitable structure to be devised whereby the joint functions of the mechanical point anchor and the anchoring capability of the setting-medium system be combined, this in a manner such that manufacturing costs of the anchor structure are minimized. The essential factors are that cost of construction, erection, and placement be reduced and the time of completed installation of the anchor be drastically minimized relative to that required by current systems.

BRIEF DESCRIPTION OF THE INVENTION

According to the present invention the anchor takes the form of a unitary elongate anchor member having an inner bore which receives an elongated casing containing a suitable setting-medium. The setting-medium system may comprise a resin system, as below described, a grouting cartridge as described in U.S. Pat. No. 4,096,944, or any other system which, upon mixing thereof, will tend to set up, harden and in effect grout in the anchor bolt in its borehole. The anchor member provided is preferably made of a suitable plastic, e.g., polyethylene, polyurethane, ABS plastic, etc., and of suitable grade, which has the characteristic of being expansive radially outwardly without essential fracture, preferably, and which, e.g., can be either internally threaded or simply receive in an optional self-tapping operation the threaded end of an anchor rod. Alternate materials for the anchor member are wood, metal, composites, etc. The anchor member herein is hollow and is also slotted so as to provide perforations, preferably elongated flow apertures or slots, for accommodating setting-medium flow once the same is mixed. The outer surface of the anchor member can have a series of teeth positioned between the slotted areas for aiding in the gripping function of the anchor member as well as enhance bonding of the setting-medium relative to such anchor member and the borehole. The tapered remote end of the anchor member can be provided with a series of longitudinally outwardly projecting teeth arranged essentially in a circular pattern. The preferably provided tapered entrance to the elongate anchor member is constructed to provide for the convenient insertion of the preferably tapered end of an elongated anchor bolt. A series of threads can be provided the interior of the anchor member whereby the suitably dimensioned anchor bolt, in being introduced within and threadedly spinned within the interior of the anchor member, causes the same to expand radially outwardly so that portions, preferably medial portions of the anchor member, are caused to thrust against the side-wall of the borehole in which the elongated member is placed.

Further serving to reduce the cost of the structure is the provision of a segment of an elongated bar, preferably common reinforcing bar otherwise know as "rebar," which has its opposite ends formed by a reheating and forging process in which suitably designed upsetter tools form the respective ends, this to supply the bolt head of the bar and also the opposite, permissibly threaded end thereof. Preferably such end can be tapered for easy and guided insertion into the anchor member. The employment of upsetter tools and the concept of reheating the ends of the bar to provide a reforging and thus a reformation of these ends is entirely new in the art. Again, a concept not only operates to produce the headed end of the rebar but also can provide threads or thread segments at the opposite or remote end of the rebar. The threads so produced on the rebar segment, when employed, and while not of the quality of machined threads or rolled threads, will still be sufficient nonetheless to provide the spinning function necessary for the rod to enter into and ultimately expand the elongate anchor member above referred to, and also to shred the setting-medium cartridge envelope and thus mix the setting-medium, allowing the same to proceed out of the slots of the anchor member; the threaded rebar segment also is spun into the threads of, or effects a self-tapping function, as to the elongate anchor member, whereby to expand radially outwardly the circumferential girth of the anchor member so that the latter forces its teeth into the wall of the borehole.

Where desired, one or more resilient flaps or functionally equivalent structure may be molded or otherwise provided in the tapered entrance of the central aperture of the elongate anchor member, this for precluding the inadvertent dropping out of the setting-medium system envelope or cartridge once the same is inserted in the bore of the elongate anchor member. The outer surface of such envelope may be designed to tightly frictionally engage the interior wall of the elongate anchor member so as to aid in retention of the setting-medium system within the anchor member even though the latter is in a vertical position and is forced upwardly into a mine formation bore hole, for example.

The invention, broadly, thus comprises the elongate anchor member taken alone, the same with the setting medium installed, and also the latter with an elongated bar, e.g., threaded at its proximate end and introduced into and secured within elongate anchor member. The anchor member is expandable radially, for borehole gripping purposes, upon the introduction therein of an elongated anchor such as a bolt, and the latter also serves as a piston to extrude the mixed setting-medium out of the slots or perforations provided in the anchor member, to co-act with the interior borehole wall in fixing such anchor therein.

OBJECTS

Accordingly, a principal object of the present invention is to provide a new and improved anchor member for elongated apertures, boreholes, and the like.

A further object is to provide an anchor for anchoring anchor bolts or like structures to a given support structure such as mine strata, foundations, dams and other structures found in the civil engineering arts, and so forth.

A further object is to provide for an improved method for constructing and installing anchor structure relative to a borehole or the like.

Another object is to provide an elongate anchor member having side wall slots and also a setting-medium member disposed within the anchor member and adapted to cause the setting-medium to proceed out of such slots upon the introduction of a spinning anchor bolt or similar structure as introduced within the anchor member.

A further object is to provide anchor structure wherein provision is made for immediate retentive securement of an anchor within an aperture or hole while a setting-medium system present in the anchor is physically activated, whereby to provide for outflow of the mixed setting-medium through the anchor wall such that a more permanent securement can be achieved.

DESCRIPTION OF DRAWINGS

The present invention, both as to its operation and advantages, may best be understood by reference to the following detailed description, taken in conjunction with the following drawings, in which.

DETAILED DESCRIPTION OF PREFERRED EMBODIMENTS

Figure 1:
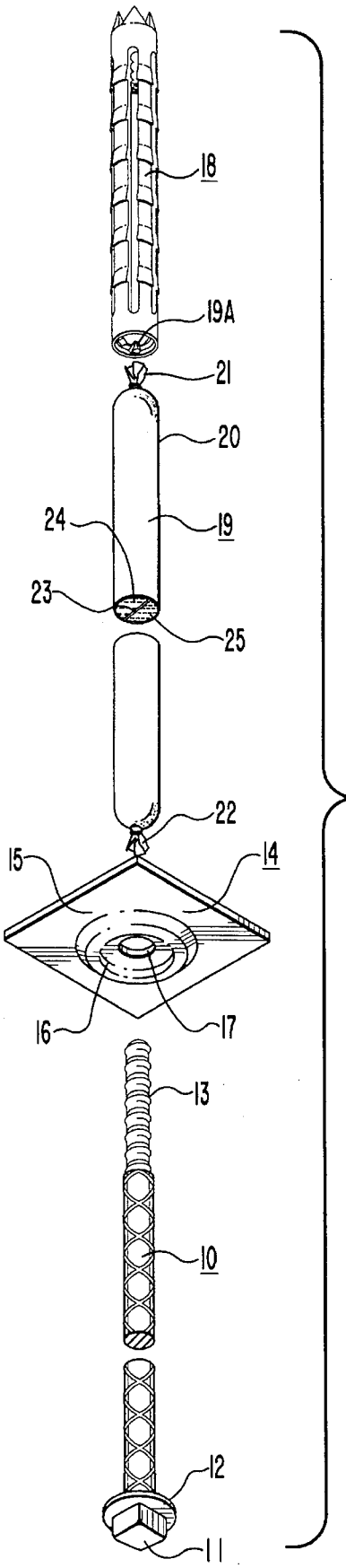
FIG. 1 is a longitudinally exploded view of a setting-medium and anchor installation incorporating the principles of the present invention.

In FIG. 1 elongated bolt 10 can comprise a rebar segment and includes a head 11 provided with an integral simulated washer 12. The opposite end of the elongated bolt 10 includes a series of threads or thread segments 13, of whatever character. For reduction in manufacturing expense it is contemplated that the elongated bolt simply be formed of a length of rebar. The opposite ends of the rebar are heated and forged by means of appropriately designed upsetter tools which will form the head 11 and washer 12, and also, where used, the roughened threads 13. The threads will not be generally so accurate as machined or rolled threads; however, the reforging process for shaping the rebar segment ends, which is deemed new in the art, will be sufficient to provide roughened threads or thread segments suitable for self-tapping or otherwise insertion into the anchor member utilized. The method, then, for supplying the elongated bolt is to provide a reinforcing bar or rebar length, heating the opposite ends, and finally reforging these ends by respective upsetter tools whereby to provide the head and washer combination at 11 and 12 and also the threads at 13. Of course, the threads can be eliminated wherein one will simply rely upon the oversize circumference of bolt 10 relative to the interior bore of the anchor member 18 to radially expand the latter upon insertion.

It is seen also in FIG. 1 that a bearing plate 14 is provided, which bearing plate includes the plate portion 15 and also a depending circular stiffener 16 provided with admittance aperture 17 for receiving elongated bolt 10. The anchor member 18 itself is seen and is designed to receive interiorly thereof a setting-medium cartridge 19A. One or more similar cartridges, see 19, can be used also, generally outside of the interior of anchor member 18, where additional securement and corrosion resistance are to be provided the anchor bolt, threaded or unthreaded. The cartridges 19 and 19A, when such comprise the resin system embodiment, each includes a plastic casing 20 which is clipped and generally tied at both ends 21 and 22. The casing 20 includes an interior partition 23, generally formed of MYLAR plastic, whereby to divide the compartments 24 and 25. Compartment 24 will include the liquid resin R, see FIG. 4, which when made by one manufacturer is generally a dark gray, and the opposite compartment 25 will include an appropriate catalyst or hardener H. Cartridges of the type as shown at 19, 19A are standard in the art and, in one form, is known in the trade by the trademark FASLOC, manufactured by the Dupont Corporation. Such resin cartridges are utilized currently in the absence of any other anchor, the resin system being utilized directly and solely in combination with the anchor bolt or roof bolt whereby to anchor the same in a bore hole in mine strata, for example. Of course, as previously explained, another type of setting-medium system can be employed, see for example, U.S. Pat. No. 4,096,944 before referenced.

Figure 3:
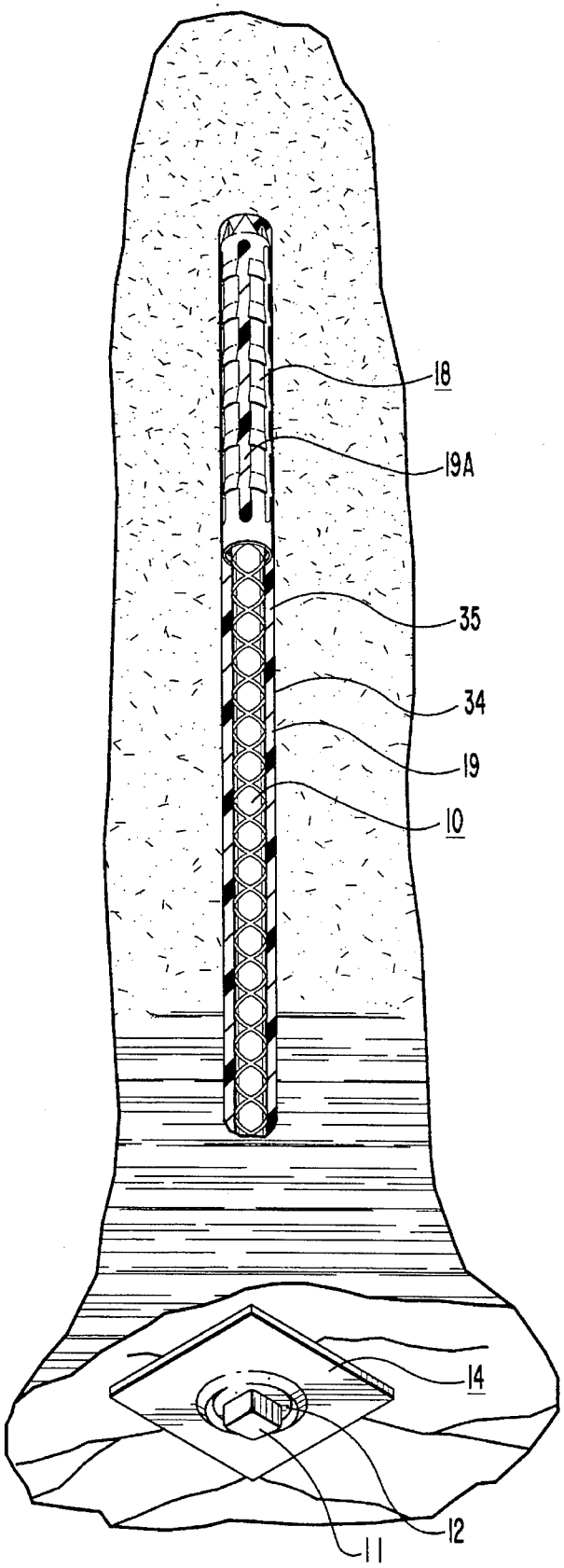
FIG. 3 is an illustration of an anchor bolt with its anchor and setting-medium system installed and set in mine roof strata by way of example.
Figure 4:
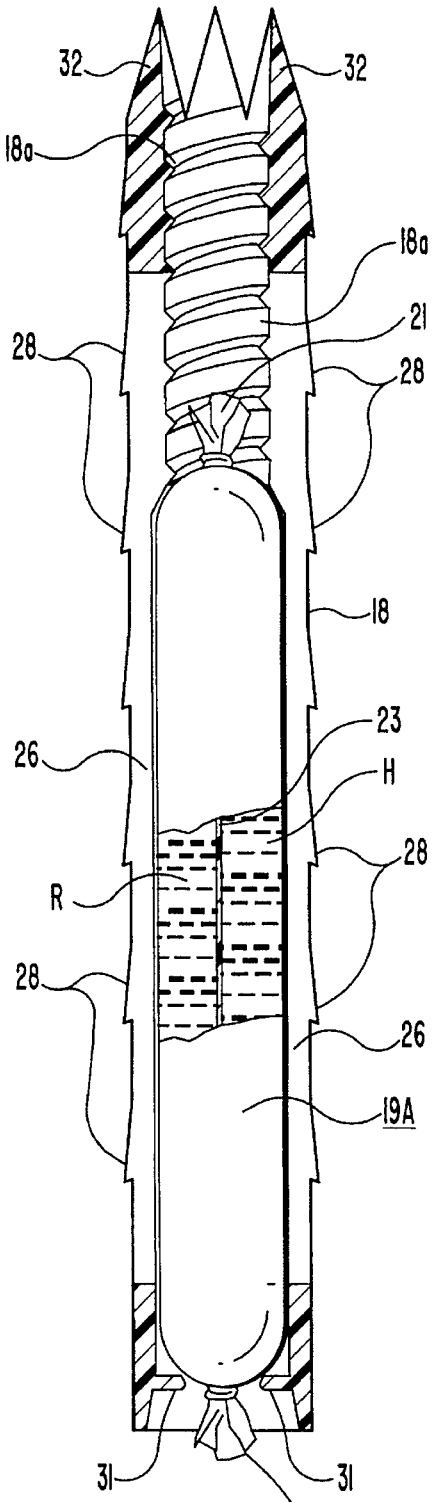
FIG. 4 is a longitudinal vertical section taken along the line 4—4 in FIG. 2.

Anchor member 18, which can be provided with threads 18*a*, see FIG. 4, is a unitary one piece anchor made, for example, of a medium soft plastic such as polyurethane or polyethylene or an ABS plastic, and which can be conveniently injection molded by standard injection molding practices; however, other materials such as metal, wood, composites, etc., can be employed so long as the finished product is radially expandable. The anchor member 18 includes a series or elongated longitudinal wall slots 26, which conveniently can be arranged in quadrature, four slots thus being provided, about the circumferential periphery of the anchor member. The wall 27 of the anchor member can be provided with a series of raised teeth 28 at those outside wall areas between the slots, at at least the upper end of the anchor member where girth expansion primarily is to occur. The teeth decline in an upward direction whereby to allow for the convenient insertion of anchor member within a borehole and also add gripping and improved bonding as before mentioned. The shoulders 29 of the respective teeth are useful for their complementary gripping function. Anchor member 18 includes an interior aperture 30 designed to receive a resin cartridge 19A in FIG. 1. The anchor member 18 is disposed in borehole 34, see FIG. 3, and is provided with one or more flaps, lips or lugs at 31, or similarly operative structure, which will preclude the inadvertent dropping out vertically of the cartridge once the same is installed within the cavity or aperture 30 of anchor member 18.

Figure 2:
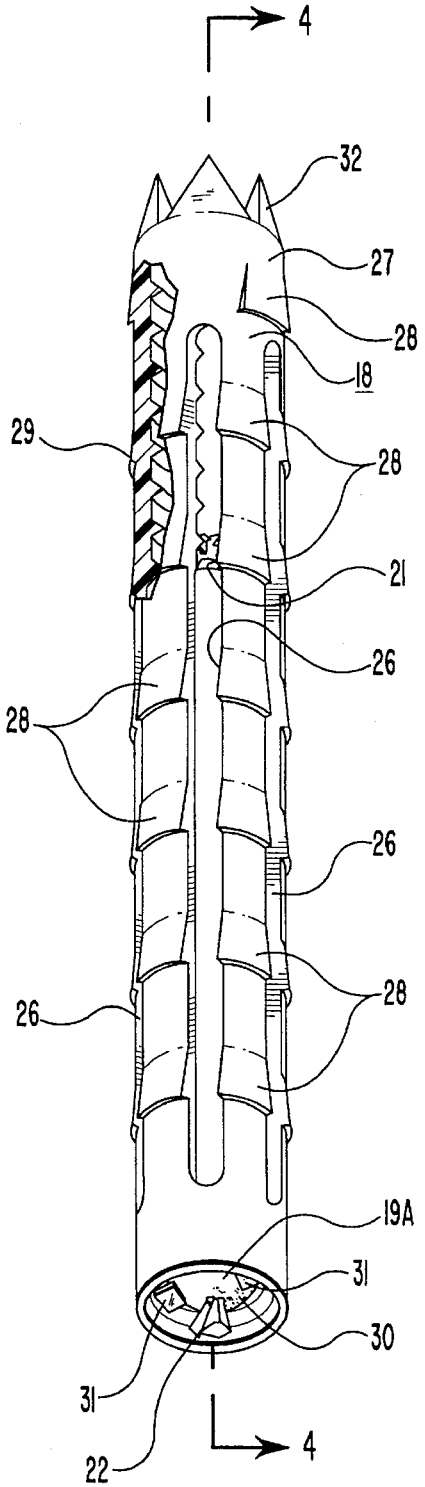
FIG. 2 is an enlarged view of the anchor member shown at the upper portion of FIG. 1.
Figure 5:
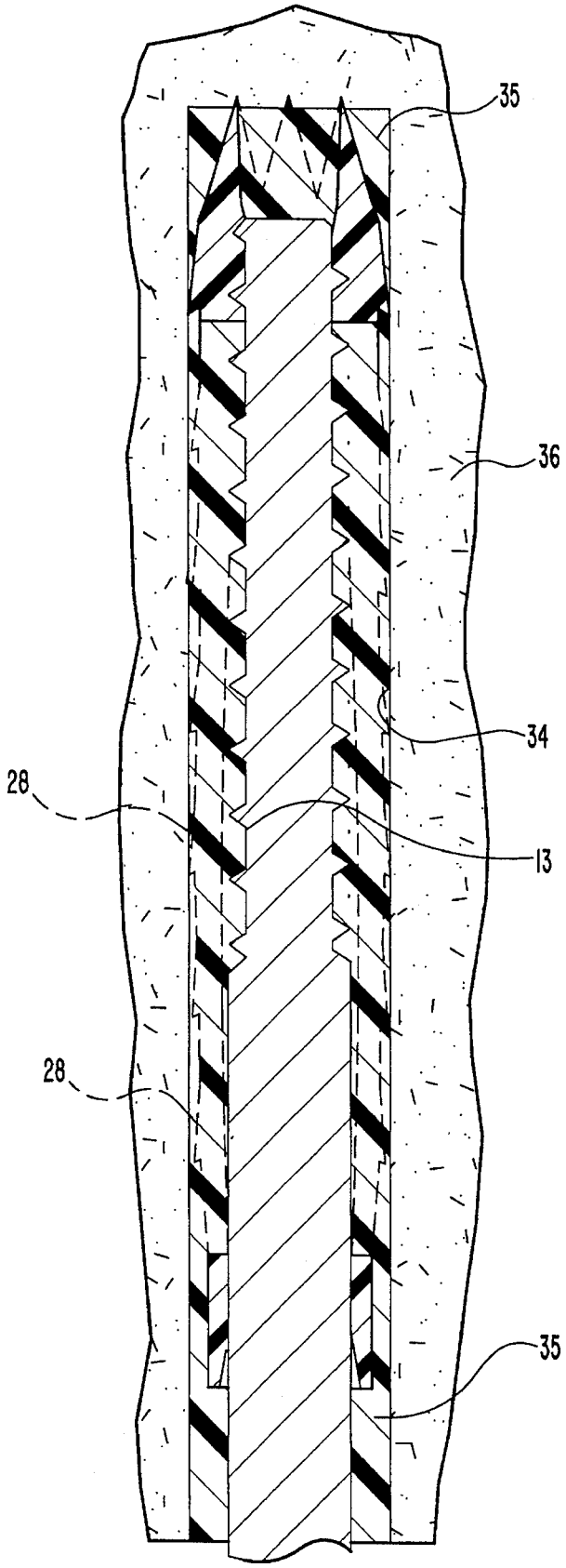
FIG. 5 is an enlarged section similar to FIG. 4 and illustrating the anchor and also the end structure of the anchor bolt wherein the setting-medium has been given sufficient time to set up, whereby to secure the anchor bolt in position within the bore hole of the strata.

Continuing with FIG. 2, upwardly directed end teeth or protuberances 32 are provided to bite into the mine roof strata at the upper end of the borehole so as to tend to preclude inadvertent rotation of the anchor member 18 about its longitudinal axis. Disposed within the anchor member 18 in FIG. 2 is the cartridge 19A. Again, the flap or lug 31 which is formed as an integral part of the interior of the anchor member will tend to retain the cartridge 19A from slipping out downwardly. FIG. 4 illustrates that, again, the resin and hardener when used can be initially separated by a temporary partition 23 prior to mixture. When the anchor bolt is thrust upwardly and rotated to complete the installation as seen in FIG. 3, then the resin and catalyst hardener, when so employed, are mixed and the casing and partition is of a constituency so as to easily shred quickly and thoroughly during the procedure of spinning the anchor bolt into position within the anchor member 18. When the cartridge is so shredded, then the mixed resin system will proceed outwardly through the wall slots 26 whereby to secure by the resin system both the anchor member 18 and the bolt 10 to the bore hole wall; additionally, the resin system will proceed downwardly and join and intermix with the likewise so shredded and mixed contents of cartridge 19, where included, whereby to secure the shaft of the anchor bolt in like manner to the interior of the bore hole at 34, see FIG. 3. The mixed resin is indicated at 35 in FIGS. 3 and 5. The threads of the anchor bolt, when employed, are seen at 13 in FIG. 5, and these threads may be self tapping, if desired, within the plastic interior of anchor member or sleeve 18 and co-act with the same in a substantial interference fit whereby to expand radially the girth of anchor member 18. Optionally, interior threads or thread portions can be provided the anchor member 18 for receiving a threaded end of the anchor bolt 10. Of course, both the anchor bolt and the anchor member can be devoid of threads, with simply the interference fit of the two being relied upon to expand radially the anchor member. Any character of end of the anchor bolt will still be effective to shred the casing and interior plastic partition of the cartridge. The section in FIG. 2 taken along line 4—4 as well as the corresponding section in FIG. 5 illustrate that the slots are available for the extruding outwardly of the mixed resin system as seen in FIG. 5 at 35, by way of example, whereby to provide the resin sufficient to secure the anchor, that is, to maintain both the bolt and anchor member in secured position within the bore hole once the anchor member is installed.

Figure 6:
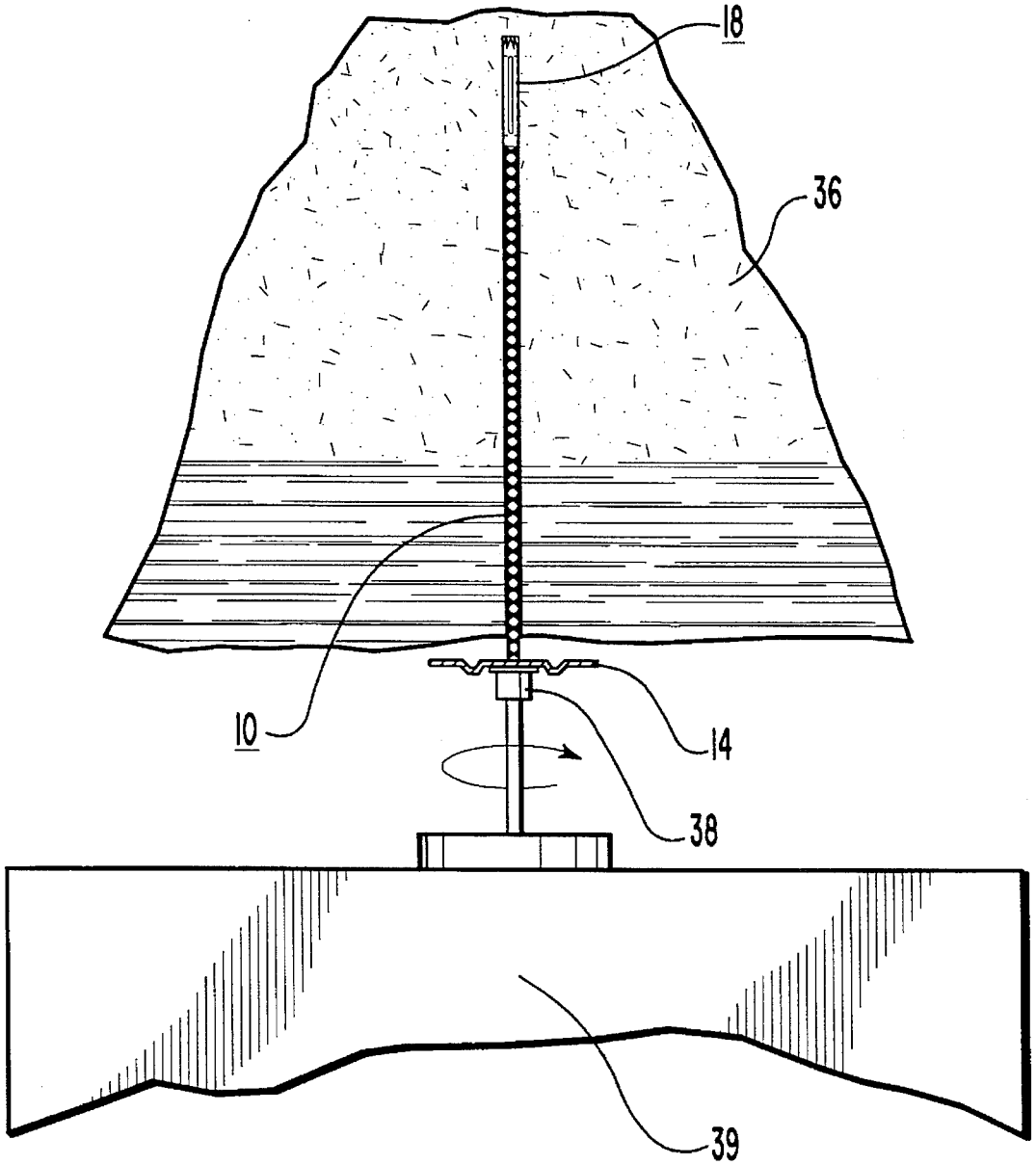
FIG. 6 illustrates the anchor system being installed by conventional machinery.

FIG. 6 the anchor bolt 10 and anchor member 18 are shown being installed by tool socket extension of machine 39. This figure illustrates at 39 that any conventional machine can be employed to drill the elongated holes, thrust the cartridge-loaded anchor member into the upper portion of a respective drilled hole, and then spin an anchor bolt or rod into the hole to mix the setting-medium and then engage and expand the anchor, e.g. anchor member 18 whereby to provide a permanent anchoring of the structure thereat. To effect the above, a conventional mobile jumbo drill with an indexing turret, as in common in hardrock mining, can be used; alternately, a stoper or jackleg drill, or other conventionally used tool or tools can be employed.

It is to be observed that the invention is useful not only for securing anchor bolts and roof bolts in the strata of underground mines, but also can be used as well, for example, in tunnelling, dam sites, and other types of constructions wherein an upstanding anchor is needed, or indeed a depending anchor, as the case may be, for the installation of accommodating external structure, for the pouring and securement of walls or other concrete structure, and so forth.

While particular embodiments of the present invention have been shown and described, it will be obvious to those skilled in the art the various changes and modifications may be made without departing from the principal aspects of the invention and therefore, the aim in the appended claims is to cover such changes and modifications that fall within the true spirit and scope of the invention.

I therefore claim:

1. Securement structure for emplacement in a borehole provided a peripheral wall, including a one-piece, radially expandable anchor having an internal bore, a cartridge containing a setting-medium and disposed within said anchor, and a threaded elongated member means, transversely cross-sectionally oversized with respect to said internal bore, for spinning into said cartridge whereby to mix said setting-medium therein and also for threadedly engaging and thereby radially expanding said anchor, for immediately gripping into the wall of said borehole, said anchor including an essentially cylindrical wall surrounding said bore and provided with a plurality of elongated, longitudinal, mutually spaced, oppositely closed-ended, setting-medium-passage wall slots communication with said bore, said cylindrical wall bearing plural sets of outwardly radially projecting, rearwardly facing, mutually spaced teeth having opposite lateral extremities which are essentially defined by respective ones of said wall slots.

2. The securement structure according to claim 1 wherein said body is provided with an interior end flap means, positioned rearwardly behind said cartridge, for permitting the pre-insertion of said cartridge into said internal bore over and past said flap means but deterring the rearward dropping out of said cartridge from said internal bore.

3. The securement structure according to claim 1 wherein said essentially cylindrical wall includes a series of forward-end projecting tooth means for penetrating into external, borehole end strata for deterring axial rotation of said anchor.

* * * * *